US006206733B1

(12) United States Patent
Wu

(10) Patent No.: US 6,206,733 B1
(45) Date of Patent: Mar. 27, 2001

(54) CONNECTION BLOCK ASSEMBLY FOR A WATERPROOF SWITCH

(76) Inventor: Chih-Yuan Wu, 8th Fl., No. 66, Chung-Chen Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 09/551,127

(22) Filed: Apr. 18, 2000

(51) Int. Cl.[7] ..... H01R 25/00; H01R 27/02; H01R 31/00; H01R 33/88; H01R 33/90

(52) U.S. Cl. ..... 439/651; 200/307

(58) Field of Search ..... 439/701, 717, 439/651, 594, 368; 200/301.1, 302.1, 303.1, 307

(56) References Cited

U.S. PATENT DOCUMENTS 3,267,246 * 8/1966 Manning ..... 200/307
3,681,552 * 8/1972 Bailey ..... 200/307
4,960,393 * 10/1990 Stoll et al. ..... 439/651

* cited by examiner

*Primary Examiner*—Paula Bradley
*Assistant Examiner*—Antoine Ngandjui
(74) *Attorney, Agent, or Firm*—Thorp Reed & Armstrong, LLP

(57) ABSTRACT

A connection block assembly for a waterproof switch is disclosed, which includes a connection block which has two holes defined on one surface each corresponding to one locking prong of awaterproof switch, two locking grooves defined on each side of the connection block assembly and corresponding to a locking rails extending from the switch body such that the waterproof switch can be connected to two switch bodies by the connection block assembly.

4 Claims, 7 Drawing Sheets

CONNECTION BLOCK ASSEMBLY FOR A WATERPROOF SWITCH

BACKGROUND OF THE INVENTION

1. Field of the Invention

The present invention relates to a connection block assembly for a waterproof switch, more particularly, to a connection block assembly to which other parts can be attached.

2. Description of Related Art

A conventional waterproof switch either has a single switch body or can be connected to two switches by a connection block assembly.

For example, as shown in FIG. 7, a waterproof switch (40) is connected to two switch bodies (70) by a conventional connection block assembly (60). The waterproof switch (40) has two prongs (42,43) extending from one end; and the conventional connection block assembly (60) contains two holes (62, 63) corresponding to the two prongs (42, 43). The conventional connection block assembly (60) has a pair of flanges (64) extending from each side. Two pins (66) extend from the connection block assembly (60) between the pair of flanges (64). An opening (642) is defined in each flange (64).

The switch body (70) to be connected to the conventional connection block assembly (60) has a protrusion (72) corresponding to each opening (642) of the conventional connection block assembly (60) and a through hole (74) corresponding to each pin (66) of the conventional connection block assembly (60).

Though the conventional connection block assembly (60) is capable of connecting the waterproof switch (40) to two switch bodies (70), some drawbacks are found as follows:

a. Since the flanges (64) and pins (66) are requisite parts of the conventional connection block assembly (60), the configuration is complicated, causing the cost to be high and the manufacturing procedure to be complicated.

b. A switch body (70) is fixedly squeezed between each pair flanges (64); and each protrusion (72) on the switch body (70) is locked in the opening (642) in the flange (64) of the conventional connection block assembly (60). Thus, when a switch body (70) is to be removed from the conventional connection block assembly (60), the flanges (64) must be bent outwards to release the switch body (70) protrusions (72) from the openings (642) in the conventional connection block assembly(60) flanges (64). Therefore, detaching the switch bodies (70) from the conventional connection block assembly (60) is very troublesome. The possibility also exists that the flanges (74), after being pushed outwards, may be permanently deformed such that the protrusions (72) cannot be locked again.

Therefore, an alternate configuration that ensures that the connection block assembly can be effectively reassembled after detaching the switch bodies is necessary.

SUMMARY OF THE INVENTION

The objective of the present invention is to provide a connection body for a waterproof switch, which can be reliably and easily reassembled after the switch bodies have been detached.

To achieve the objective, the connection block assembly for a waterproof switch in accordance with the present invention comprises two prong holes and locking grooves.

The prong holes are defined on one surface of the connection block assembly and correspond to the prongs of a waterproof switch. Two locking grooves are defined on each side of the connection block assembly and correspond to locking rails extending from the side of the switch body such that the waterproof switch can be connected to two switch bodies by the connection block assembly.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
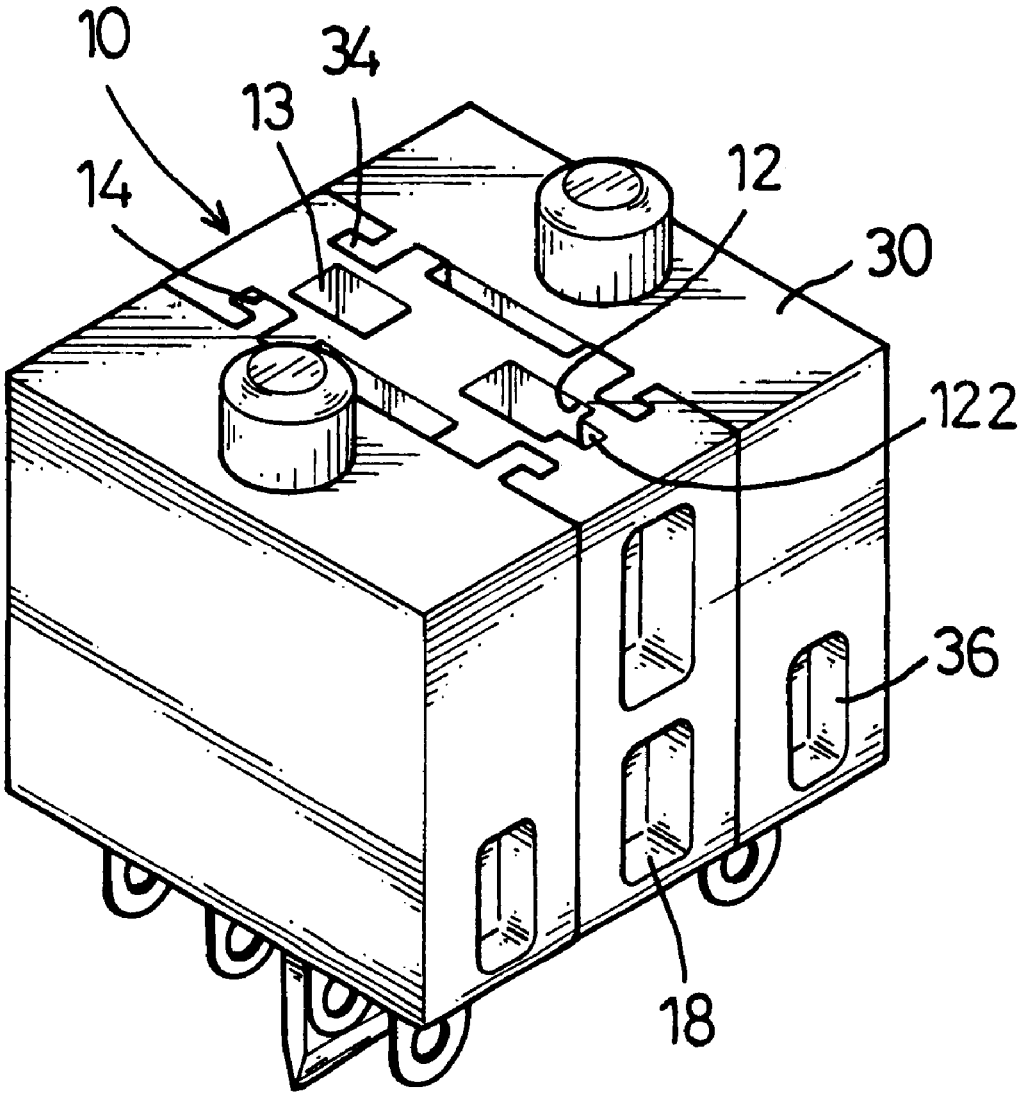
FIG. 1 is a perspective view of the connection block assembly for a waterproof switch in accordance with the present invention combined with two switch bodies.
Figure 2:
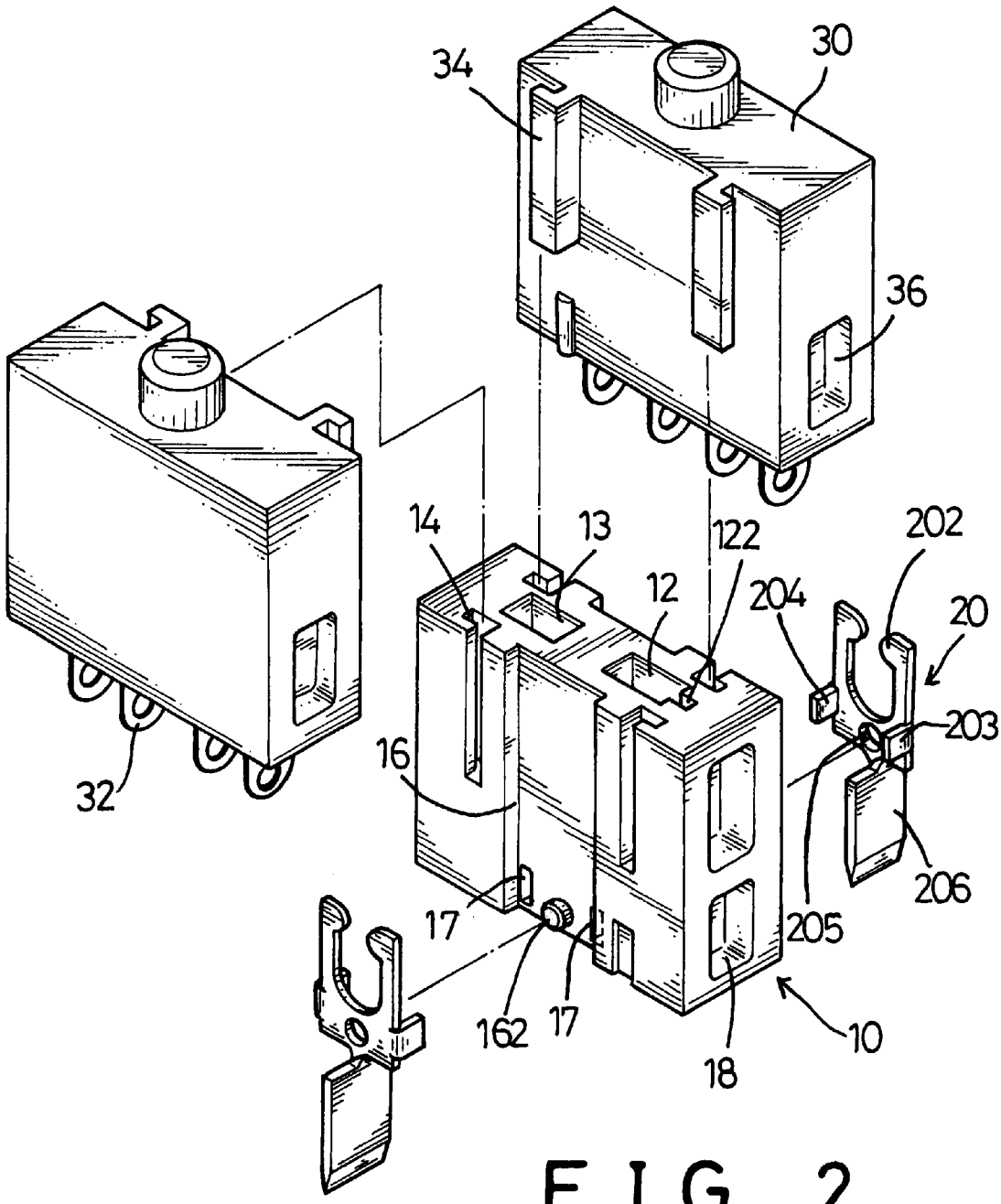
FIG. 2 is exploded perspective view of the connection block assembly for a waterproof switch and two switch bodies in FIG. 1.
Figure 3:
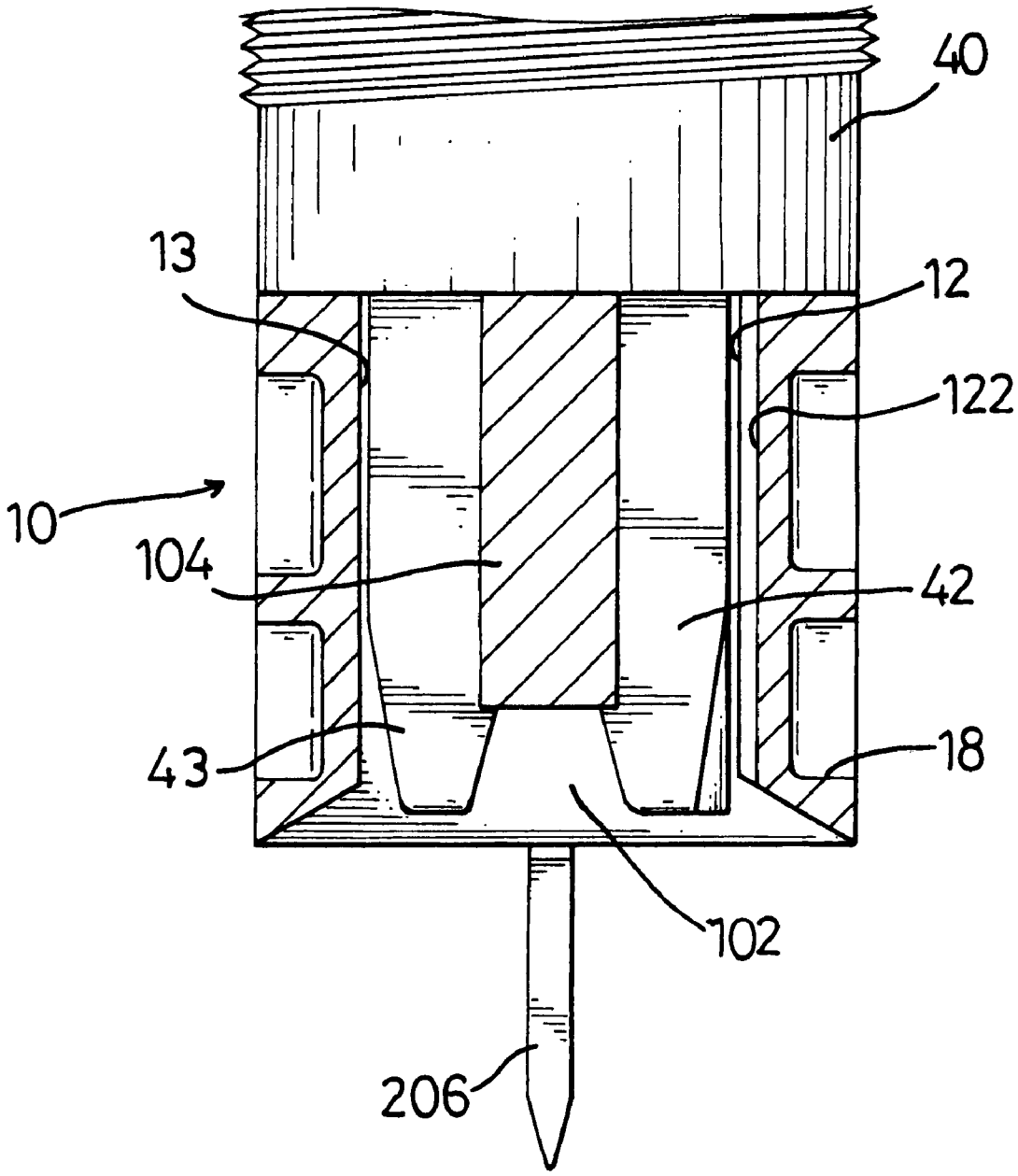
FIG. 3 is a side plan view in partial section of the connection block assembly for a waterproof switch in FIG. 1.

With reference to FIGS. 1, 2 and 3 the connection block assembly for a waterproof switch (40) in accordance with the present invention comprises a connection block (10), multiple blades (20) and multiple switch bodies (30).

The connection block (10) contains two holes (12, 13) defined in one surface and two locking grooves (14) defined on opposite ends of each side. Two locking holes (17) are defined on the side of the connection block (10) where the locking grooves (14) are defined and located below the locking grooves (14). A recessed area (16) is defined on each side between the two locking grooves (14). A locking cavity (18) is defined on each of the other two sides of the connection block (10). A longitudinal groove (122) is defined on the inside of one of the holes (12) on the side away from the other hole (13), and a cavity (102) is formed between the bottom of the two holes (12, 13). A protrusion (162) is defined in the recessed area (16) between the locking holes (17).

Figure 6:
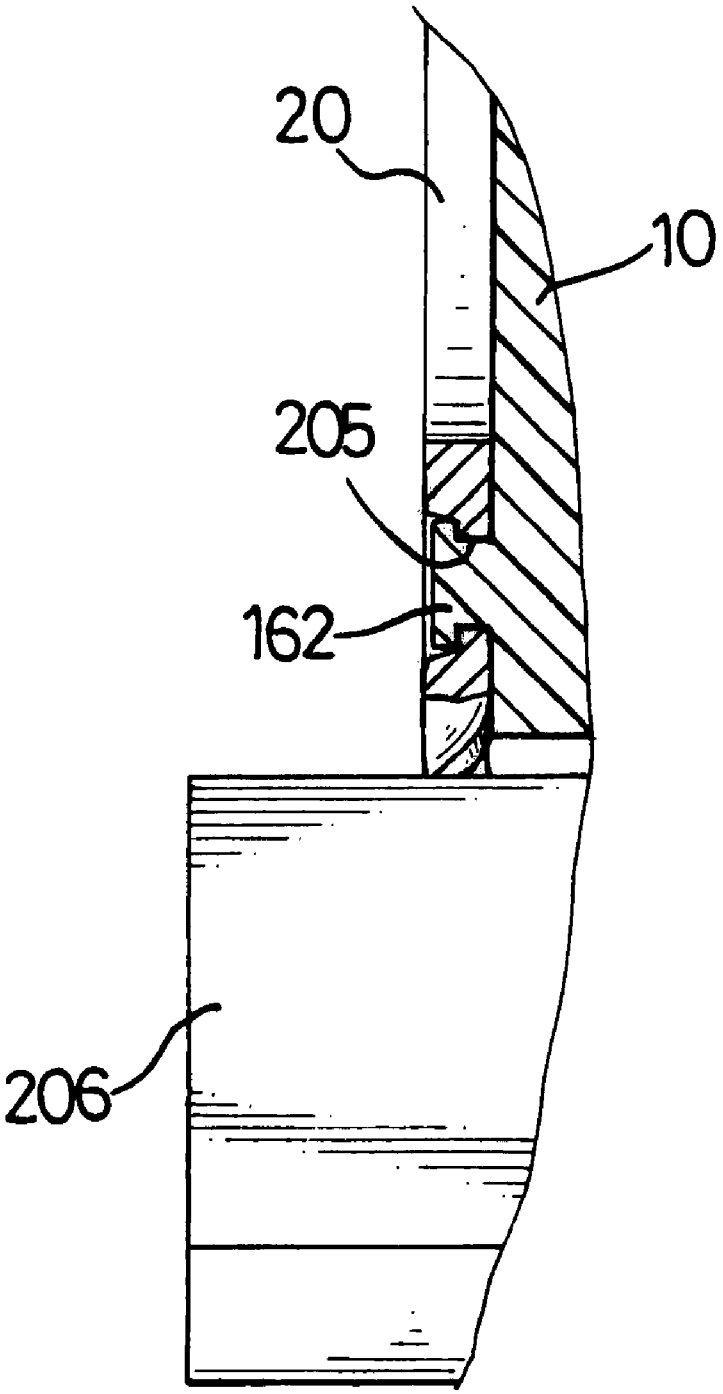
FIG. 6 is a front plan view in partial section of the connection block assembly blade in FIG. 5 attached to the connection block assembly.
Figure 7:
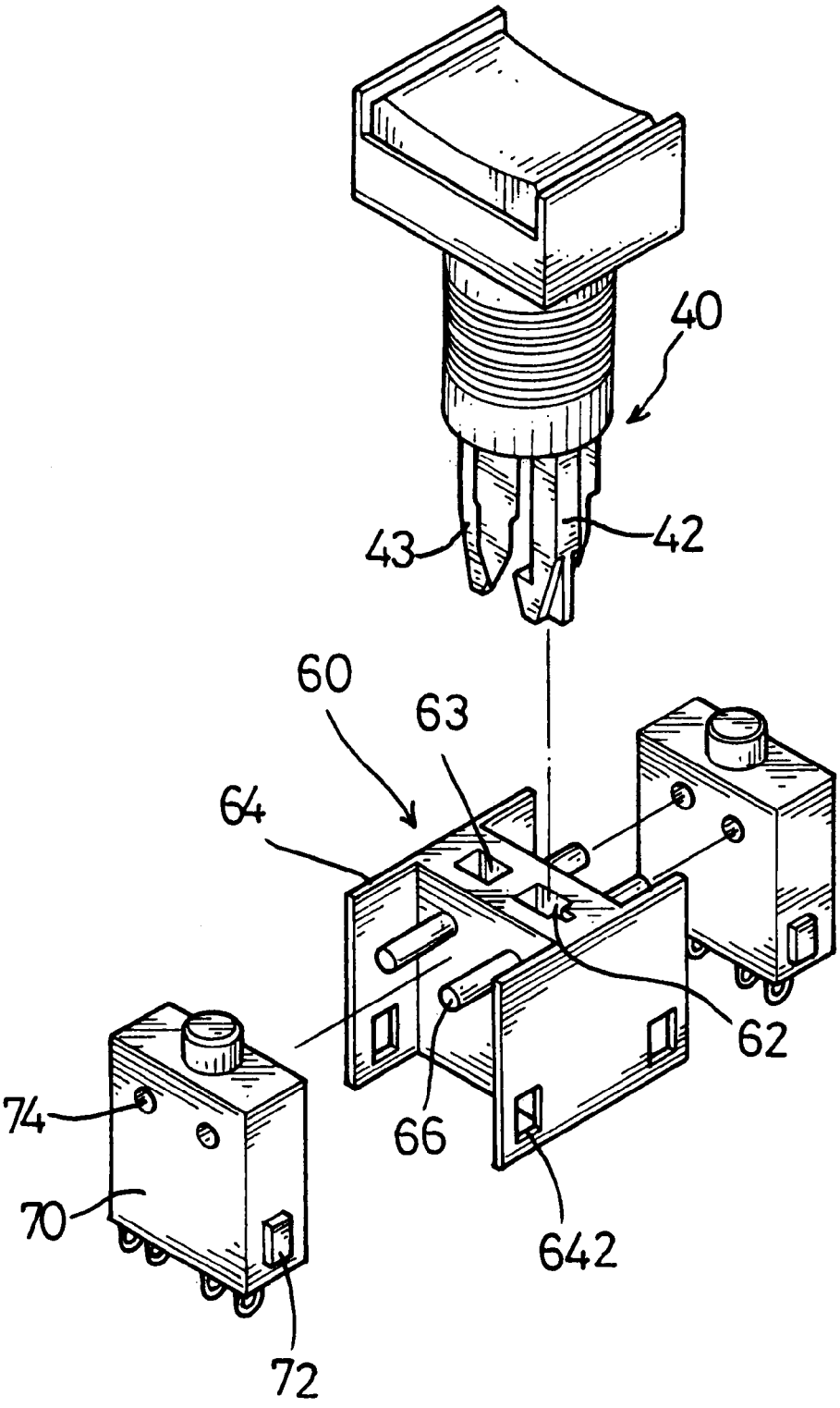
FIG. 7 PRIOR ART
FIG. 7 is an exploded perspective view of a conventional connection block assembly in accordance with the prior art when connected with two conventional switch bodies.

A blade (20) is installed in each recessed area (16) of the connection block (10). Each blade (20) has two opposed contact arms (202), two locking protrusions (203, 204), a flat prong (206) and a through hole (205). The opposed contact arms (202) extend from one end. The two locking protrusions (203, 204) extend perpendicular to and from under the two contact arms (202). The locking protrusions (203, 204) are configured so that the locking protrusions (203, 204) correspond to the locking holes (17) in the recessed area (16). The flat prong (206) extends from the end opposite to the contact arms (202). The through hole (205) is defined at a position between the contact arms (202) and between the locking protrusions (203, 204) and the flat prong (206). The through hole (205) corresponds to the protrusion (162) in the recessed area (16) when the blade (20) protrusions (203, 204) are inserted into the locking holes (17). With reference to FIG. 6, after the protrusion (162) extends through the through hole (205), the end of the protrusion (162) is melted, flattened and enlarged to lock the blade (20) in the recessed area (16). The flat prongs (206) are so configured that the top of each flat prong (206) abuts the bottom of the respective connection block (10).

The switch bodies (30) are conventional, except that the body (30) has two locking rails (34) defined on one side and corresponding to the locking grooves (14) of the connection block (10), and a locking cavity (36) on each end aligned with the locking cavity (18) on the connection block (18). By sliding the locking rails (34) into the corresponding locking grooves (14) of the connection block (10), the switch bodies (30) can be detachably connected to the connection block (10).

Figure 4:
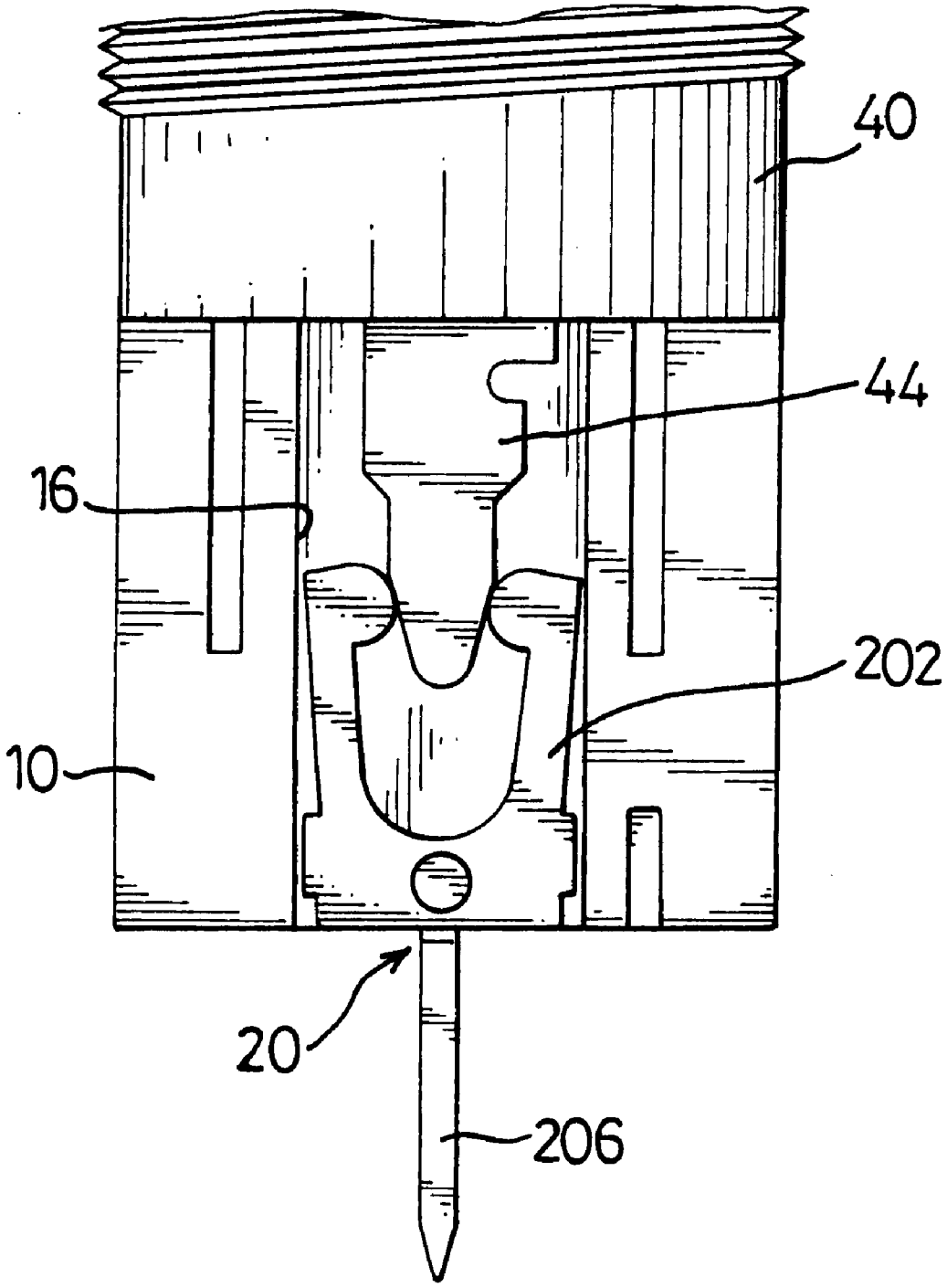
FIG. 4 is a side plan view of the connection block assembly for a waterproof switch in FIG. 1 and a waterproof switch.

With reference to the FIGS. 2, 3 and 4, the waterproof switch (40) is conventional with two prongs (42, 43) capable of being inserted into the holes (12, 13) of the connection block (18) and locked by the block (104) defined between the two holes (12, 13). The waterproof switch (40) also has two conductive blades (44) extending from the bottom corresponding to the recessed area (16) of the connection block (10). When connecting the waterproof switch (40) to the connection block (10) and the two blades (20), the two locking prongs (42, 43) are inserted into the holes (12, 13) and are then locked into the cavity (102) by the hooks on the waterproof switch (40) locking prongs (42, 43) grasping the central block (104) of the connection block (10). Simultaneously, the conductive blades (44) are received in the recessed area (16) and pressed between the contact arms (202) of the corresponding blade (20), such that the waterproof switch (40) can be electrically connected to one or more electric appliances. Since the switch bodies (30) can be, detachably connected to the connection block (10), the waterproof switch (40) together with the connection block (10) can be easily disconnected from the blades (20).

Figure 5:
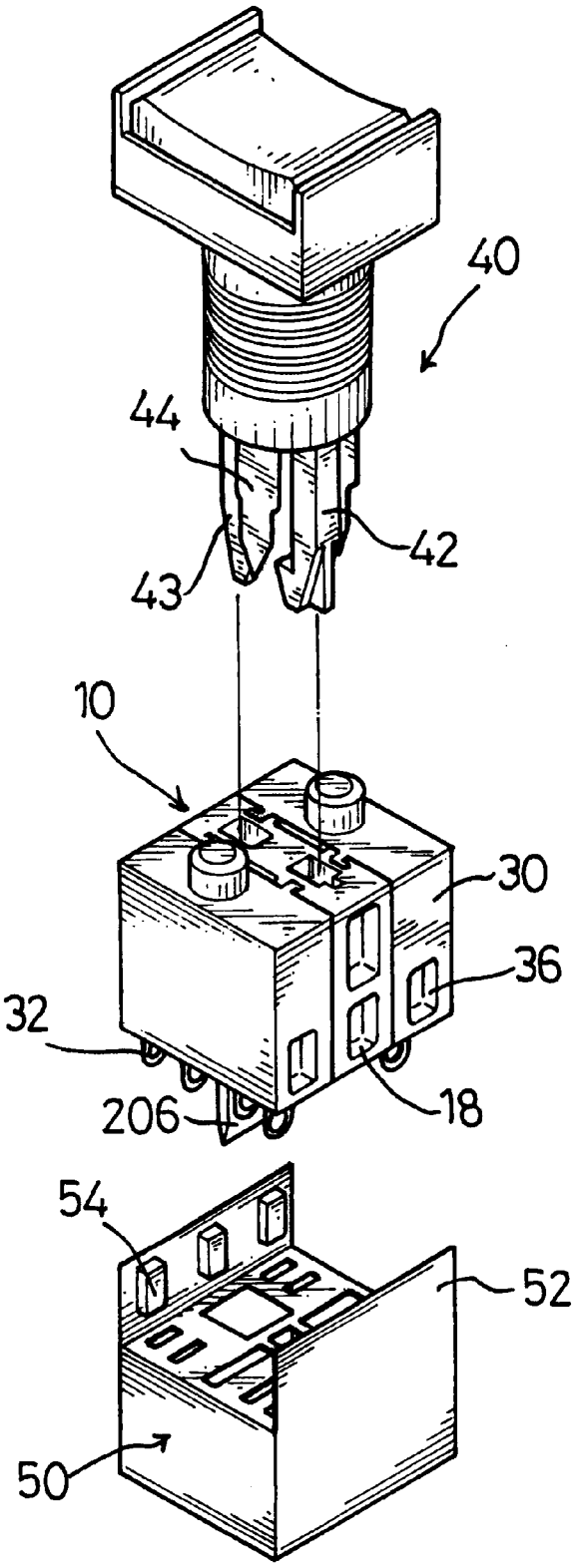
FIG. 5 is an exploded perspective view of the connection block assembly for a waterproof switch in FIG. 1 with a protective block attached.

Additionally, with reference to FIGS. 2, 5 and 6, a protective block (50) can be attached to the connection block assembly for a waterproof switch (40) in accordance with the present invention. The protective block (50) has two protective flanges (52) each extending from one side of the protective block (50). Three protrusions (54) are defined on the inside face of each protective flange to correspond to the locking cavities (18) in the connection block (10) and the locking cavities (36) of each switch (30). The protective block (50) can be locked on the assembled connection block (10) and switch bodies (30) to further protect and lock the assembly together.

Although the present invention has been explained in relation to its preferred embodiment, it is to be understood that many other possible modifications and variations can be made without departing from the spirit and scope of the invention as hereinafter claimed.

What is claimed is:

1. A connection block assembly for a waterproof switch (40) comprising:

a connection block (10) comprising
- two holes (12, 13) defined on one surface thereof;
- two locking grooves (14) defined on two opposite sides;
- two locking holes (17) defined on each side of the connection block (10) where the locking grooves (14) are defined, and located below the two locking grooves (14);
- a recessed area (16) defined on the side where the two locking grooves (14) are defined;
- two locking cavities (18) respectively defined on the other two sides of the connection block (10);
- a groove (122) defined on the inside of the hole (12) on the side away from the other hole (13) and a cavity (102) is formed at the bottom of the two holes (12, 13);
- a protrusion (162) defined in the recessed area (16); and a blade (20) mounted in each recessed area (16) of the connection block, each blade (20) comprising
- two opposed contact arms (202) extending from one end thereof;
- a locking protrusion (203, 204) extending perpendicular from the side below the two contact arms (202);
- a flat prong (206) extending from the other end; and
- a through hole (205) defined between the locking protrusions (203, 204) and between the contact arms (202) and the flat prong (206) and corresponding to the protrusion (162) in the recessed area (16) of the connection block (10); and two switch bodies (30) attached to the connection block (10).

2. The connection block assembly for a waterproof switch (40) as claimed in claim 1, wherein the locking protrusions (203, 204) are so configured that the locking protrusions (203, 204) correspond to the locking holes (17), such that each locking protrusion (203, 204) can be locked in the one of the locking holes (17) while the blades (20) are respectively received in a recessed area (16) of the connection block (10).

3. The connection block assembly for a waterproof switch (40) as claimed in claim 1, wherein the flat prongs (206) are so configured that the top of each flat prong (206) abuts the bottom of the connection block (10).

4. The connection block assembly for a waterproof switch (40) as claimed in claim 1, wherein the protrusions (162) are melted, expanded and flattened in the through holes (205) to securely attach the blades (20) to the connection block (10), such that when the switch bodies (30) are attached to or detached from the connection block (10) the blades (20) will not be detached from the connection block (10).

* * * * *